United States Patent [19]

Sheehan

[11] Patent Number: 4,723,370

[45] Date of Patent: Feb. 9, 1988

[54] SAFETY DEVICE

[76] Inventor: Maurice J. Sheehan, 3 Darbyshire Court, Mill Park, Victoria 3082, Australia

[21] Appl. No.: 934,750

[22] Filed: Nov. 25, 1986

[51] Int. Cl.[4] ..... F41C 17/02

[52] U.S. Cl. ..... 42/70.07

[58] Field of Search ..... 42/70.07

[56] References Cited

U.S. PATENT DOCUMENTS

| | | | |
|---|---|---|---|
| 2,512,140 | 6/1950 | Childs et al. | 42/70.07 |
| 2,948,978 | 8/1960 | Salverda | 42/70.07 |
| 3,139,694 | 7/1964 | Schaefer | 42/70.07 |
| 3,392,471 | 7/1968 | Foote | 42/70.07 |

FOREIGN PATENT DOCUMENTS

| | | | |
|---|---|---|---|
| 100975 | 8/1923 | Switzerland | 42/70.07 |

*Primary Examiner*—Deborah L. Kyle
*Assistant Examiner*—Michael J. Carone
*Attorney, Agent, or Firm*—Larson and Taylor

[57] ABSTRACT

A safety device for use with firearms which comprises opposed contact means, each of which defines an enclosed opening, the means being on separate members and being arranged so that they can be moved apart to be located between the trigger guard of a firearm and the trigger of the firearm, with the trigger being depressed, the device having securing means whereby, when the required position is achieved, the contact means are maintained in this position.

3 Claims, 3 Drawing Figures

SAFETY DEVICE

This invention relates to a safety device, and in particular to a safety device for use with firearms.

Firearms, in particular shoulder firearms such as rifles, shotguns and the like, hereinafter called firearms, are used by persons for sport, competition or in the course of their duties for example, police and security duties. Safety considerations are paramount in the handling and storage of such potentially dangerous devices.

Many firearms include a safety catch, a locking or cut off device which prevents the firearm from being fired accidentally, even when the firearm is loaded. However this safety mechanism does not prevent arming and discharge of a firearm by unauthorised persons, including children.

One means of preventing unauthorised discharge of the firearm is a device which locks over the trigger guard of the firearm. This device effectively encloses the trigger guard and thus prevents access to the trigger. A disadvantage of this form of safety device is that it must be dimensioned so as fit closely over the trigger guard if it is to be effective. As is known, the dimensions of the trigger guard may vary between various models and makes of firearms. Thus, this prior art guard safety device is not adapted to fit all models or brands of firearms.

It would be desirable to have a safety device that will fit a wide variety of firearms, which device is at least as effective as existing means for preventing unauthorised use of the firearm.

An object of the present invention is to provide a safety device which may be adjustable so as to fit a wide variety of firearms.

In its broadest form my invention comprises a safety device adapted to be used with firearms, comprising opposed contact means, each of said contact means defining an enclosed opening, the longitudinal distance between the two contact means being adjustable, and further including securing means for fixing the distance between the two contact means.

In order that the invention may be more readily understood, reference will be made to the accompanying drawings, in which.

Figure 1:
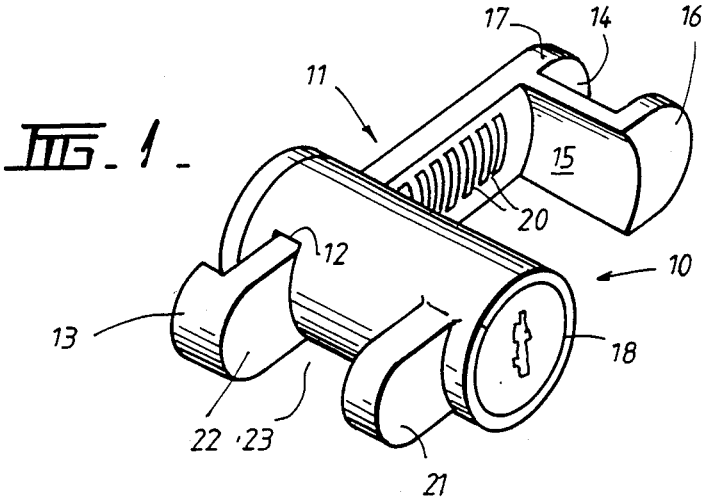
FIG. 1 is a perspective view of the device of the invention.

The device comprises a body 10 and an elongate member 11 which is adapted for movement through a slot 12 in the body.

The elongate member 11 has an enlargement 13 on one end thereof to prevent it from being removed from its location in the body and has a U-shaped member 14 at the other end thereof.

The U-shaped member has a base 15 which may be substantially complementary with the body 10 and an arm 16, the base 15 being spaced inwardly from the end 17 of the elongate member 11.

Figure 3:
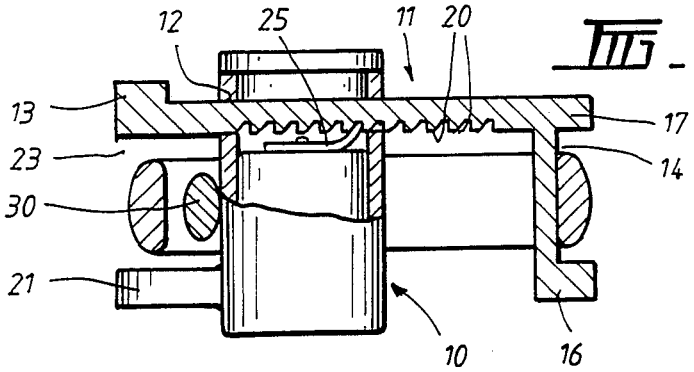
FIG. 3 is a section along line 3—3 of FIG. 2.

Formed on the inner surface of the member 11 there are a plurality of ratchet faces 20 which are arcuate in form and which may be cut into the surface of the member 11, as can be seen best in FIG. 3.

The body 10 has a rearward extension 21 which, together with the end 22 of the elongate member which has the enlargement 13 and the intervening portion of the body 10, also forms U-shaped member 23 corresponding to the U-shaped member 14 on the other end of the elongate member.

Figure 2:
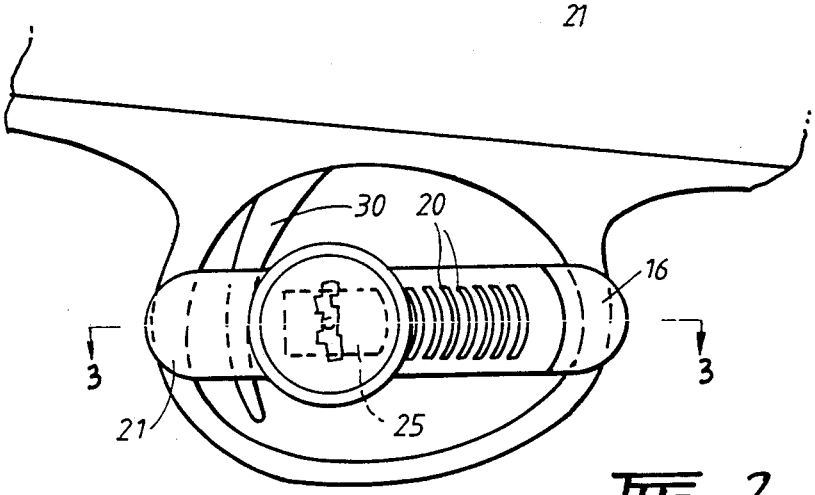
FIG. 2 is a side view of the device of FIG. 1 shown in position on a firearm.

Mounted in the body there is a lock barrel 18 and it has, on its inner end, a pawl 25 which can be seen in FIG. 3 and in dotted outline in FIG. 2, which pawl is adapted to enter any one of the ratchets 20 when the lock barrel is rotated from a position at which the pawl is located above the ratchets 20.

This pawl 25 may be of a spring material so that, when it is in the locked position, illustrated in FIG. 3, it is possible to cause the elongate member 11 to move outwardly relative to the body 10 but not move inwardly relative to the body.

If the elongate member is to be move inwardly relative to the body, then it is necessary that the pawl 25 be released from the ratchet 20, at which time the member can freely slide through its slot 12.

When the device is to be used, it is necessary to first ensure that the firearm is not loaded or cocked and the trigger can be depressed.

Then it is necessary to reduce the spacing between the two U-shaped members 14 and 23 so that the device can be placed within the trigger guard and, provided this spacing is satisfactory, then the pawl 25 can be located in its engaged position by operating the lock and rotating the barrel 12, after which rotation the key can be removed from the lock.

The device is then located in the trigger guard with the U-shaped recess 14 being directed to the forward end of the guard and the U-shaped recess 23 enclosing the trigger and with the end 22 of the elongate member 11 and the extension 21 being rearwardly directed.

These members, thus, enclose the trigger and extend beside the rear of the trigger guard.

Once the device is located, pressure is applied between the body 10 and the enlargement 13 on the elongate member and the elongate member is caused to move outwardly by the pawl 25 moving over the ratchet 20 until the base 15 of the U-shaped member 14 is closely abutting the front of the trigger guard and the body 10 is in abutment with the trigger 30 and the trigger is in its rearmost position. That is, the trigger is in such a position that the firearm cannot be cocked.

It will be seen that, at this time, the weapon is effectively safe from inadvertent or deliberate misuse in that the device cannot be removed without operation of the key, as the pawl prevents movement against the ratchet in the direction which would free the device and, because the trigger is maintained in its rearward position, the firearm cannot, as discussed, be cocked.

Whilst, in the Figures, I have shown a particular arrangement of ratchet and pawl, it will be appreciated that this can be varied, depending upon the degree of control and the amount of movement required.

Whilst I have described in this arrangement, a key and lock arrangement operating on a ratchet and pawl, it is to be understood that various other locking means may be provided if required and, for example, if complete security is not needed, a thumb screw or even a normal screw or Allen key could be used to retain the components in position, with the trigger retracted, so that no inadvertent firing of the firearm could be effected.

Alternatively, some inbetween type of mechanism, such as one which was child-proof, say which needed two different steps to release it, could be provided whereby an adult could readily remove or replace the device, but a child could not.

Also, it could be preferred to provide an arrangement whereby there is a normal bias to extend the elongate member from the barrel so that, when the device is located, it automatically adopts its final position and, using such an arrangement, it would only be then necessary to effectively lock the two components.

I claim:

1. A safety device for firearms, for use with a trigger and trigger guard to prevent unintended movement of the trigger, comprising a key operated lock enclosed in a housing, an elongated rigid member of a length greater than the longitudinal length of the trigger guard, said elongated member extending through said housing by way of apertures therein, said elongated member being bifurcated at one end to permit engagement of the trigger guard between the bifurcations, a projection from said housing extending parallel to and spaced by a distance greater than the lateral width of the trigger and trigger guard from said elongated member in the region of the other end thereof, and retaining means operated by operating the lock to retain the elongated member at a selected position relative to the housing, the said other end of the elongated member and the projection extending one on each side of the trigger guard so that, together with the bifurcated end of the elongated member, transverse movement of the safety device relative to the trigger guard is restricted.

2. A device as claimed in claim 1 further comprising means to normally urge the bifurcated end of the elongated member away from the housing.

3. A device as claimed in claim 1, wherein the retaining means includes a pawl in the housing and a ratchet on the elongated member, means for removing the pawl from contact with the ratchet to enable free movement of the elongated member relative to the housing.

* * * * *